United States Patent [19]

Bauer

[11] 3,930,783

[45] Jan. 6, 1976

[54] PRIMARY CONTROL MEANS FOR FURNACES

[75] Inventor: Frederick T. Bauer, Holland, Mich.

[73] Assignee: Robertshaw Controls Company, Richmond, Va.

[22] Filed: Aug. 19, 1974

[21] Appl. No.: 498,263

Related U.S. Application Data

[60] Division of Ser. No. 363,325, May 24, 1973, Pat. No. 3,873,955, said Ser. No. 363,325, is a continuation of Ser. No. 109,487, Jan. 25, 1971, abandoned, said Ser. No. 109,487, is a division of Ser. No. 866,528, Oct. 15, 1969, Pat. No. 3,624,407.

[52] U.S. Cl. ..... 431/78; 337/72

[51] Int. Cl.[2] ..... F23N 5/08

[58] Field of Search ..... 431/78, 80, 69, 25; 236/91; 307/116; 337/72

[56] References Cited

UNITED STATES PATENTS

| | | | |
|---|---|---|---|
| 3,610,789 | 10/1971 | Jones | 431/78 X |
| 3,627,458 | 12/1971 | Wade | 431/78 X |
| 3,701,137 | 10/1972 | Hulsman | 431/80 |

*Primary Examiner*—Edward G. Favors
*Attorney, Agent, or Firm*—Malcolm R. McKinnon

[57] ABSTRACT

Primary control means for furnaces and the like including burner control means, means including solid state means effective to control said burner control means in response to a flame detector signal, bimetallic safety switch means, and means for interfacing between an isolated low voltage control circuit and said burner control means.

7 Claims, 8 Drawing Figures

FIG. 4A
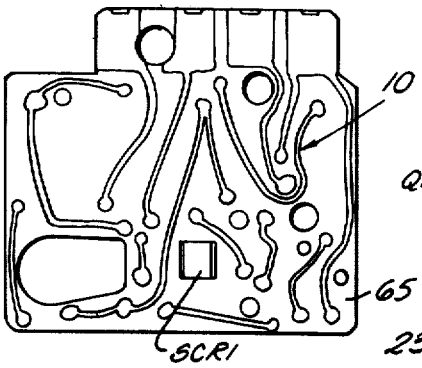
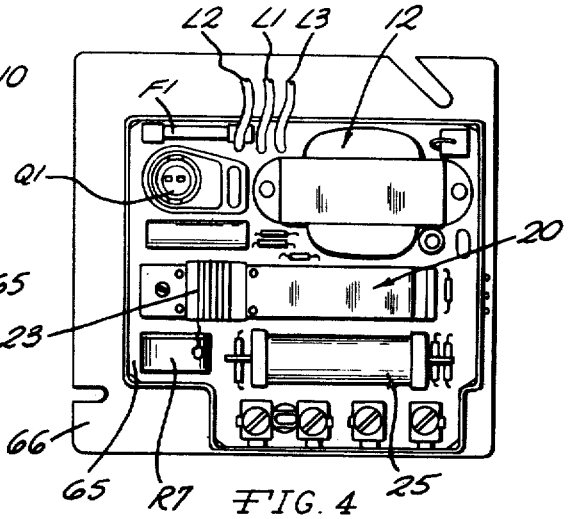
FIG. 4
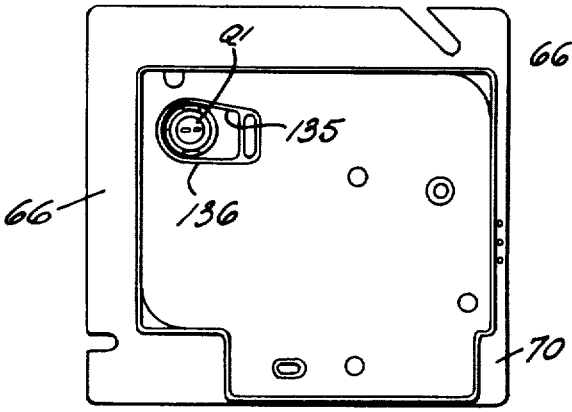
FIG. 3
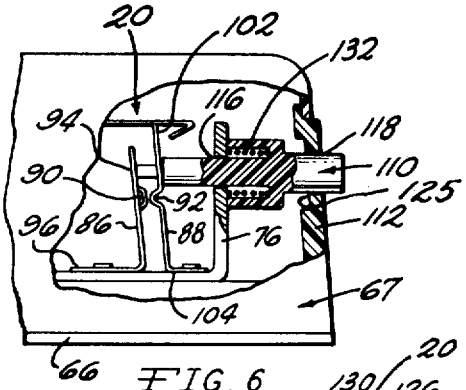
FIG. 6
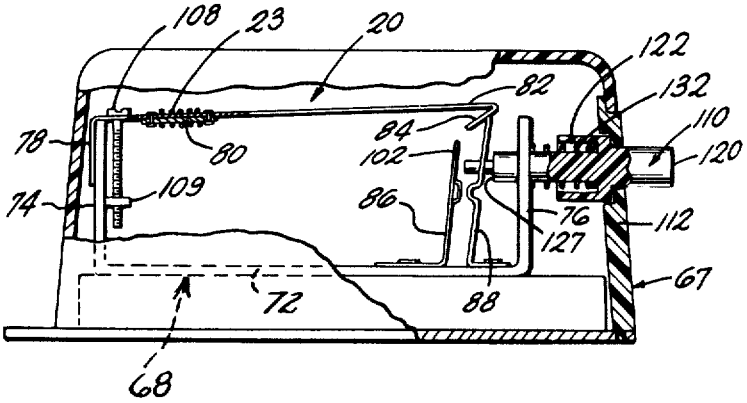
FIG. 5
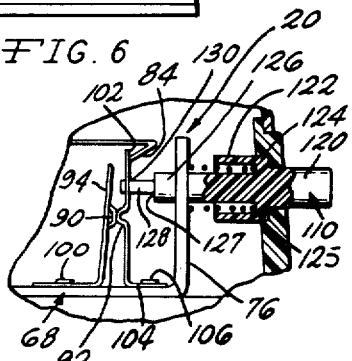
FIG. 7

PRIMARY CONTROL MEANS FOR FURNACES

CROSS REFERENCE TO RELATED APPLICATIONS

This application is a division of the applicant's co-pending application Ser. No. 363,325, filed May 24, 1973 now U.S. Pat. No. 3,873,955. Application Ser. No. 363,325, now U.S. Pat. No. 3,873,955, is a continuation of co-pending application Ser. No. 109,487, filed Jan. 25, 1971, now abandoned, and application Ser. No. 109,487 is a division of co-pending application Ser. No. 866,528, filed Oct. 15, 1969, now U.S. Pat. No. 3,624,407.

BRIEF SUMMARY OF THE INVENTION

This invention relates to primary control means for furnaces and the like and, more particularly, to an improved primary control incorporating an improved control circuit and an improved bimetallic type safety switch and effective to control a burner of a furnace.

In the past, primary controls have been utilized to control the burners in furnaces and such prior primary controls have incorporated relatively bulky, heavy and complicated main motor relays and safety circuit relays which function to control the furnace burner. Prior primary controls for furnaces have become increasingly complicated and expensive in the attempts to control reliably the furnace burners and such prior primary controls have many complicated, interrelating parts which are heavy, bulky and expensive and incorporate numerous moving parts with the result that prior primary controls have a relatively short life and are often plagued with service problems.

An object of the present invention is to overcome the aforementioned as well as other disadvantages of prior primary controls for furnaces and to provide an improved primary control which eliminates the necessity of providing main motor and safety circuit relays, which provides improved furnace burner control, and which is extremely reliable in operation.

Another object of the invention is to provide an improved primary control for furnaces which is relatively compact and light in weight, which operates with relatively little heat generation, and which is readily adaptable to meet the control requirements of various types of furnaces.

Another object of the invention is to provide an improved primary control for furnaces which incorporates improved and greatly simplified means for controlling furnace burner operation.

Another object of the invention is to provide an improved primary control for furnaces which is economical and commercially feasible to manufacture, assemble and test with mass production labor and methods and which is durable and efficient in operation.

Another object of the invention is to provide an improved primary control for furnaces incorporating improved means assuring fail-safe operation of the unit and associated furnace burner.

The above as well as other objects and advantages of the present invention will become apparent from the following description, the appended claims and the accompanying drawings.

BRIEF DESCRIPTION OF THE DRAWINGS

FIG. 3 is a top view of the base of the primary control illustrated in FIG. 2;

FIG. 4 is a top view of the circuit board of the primary control illustrated in FIG. 2, showing the components of the circuit illustrated in FIG. 1 assembled thereon;

FIG. 4A is a bottom view of the structure illustrated in FIG. 4 and indicating the circuitry embodied thereon;

FIG. 5 is a partial cut away section of the primary control illustrated in FIG. 2 and illustrating the bimetallic type safety switch embodied therein with the contacts thereof in the open position;

FIG. 6 is a partial cut away section of the structure illustrated in FIG. 5, showing the same during the resetting operation thereof; and FIG. 7 is a partial cut away section of a portion of the structure illustrated in FIG. 5, showing the safety switch contacts in the closed condition.

DETAILED DESCRIPTION

Figure 1:
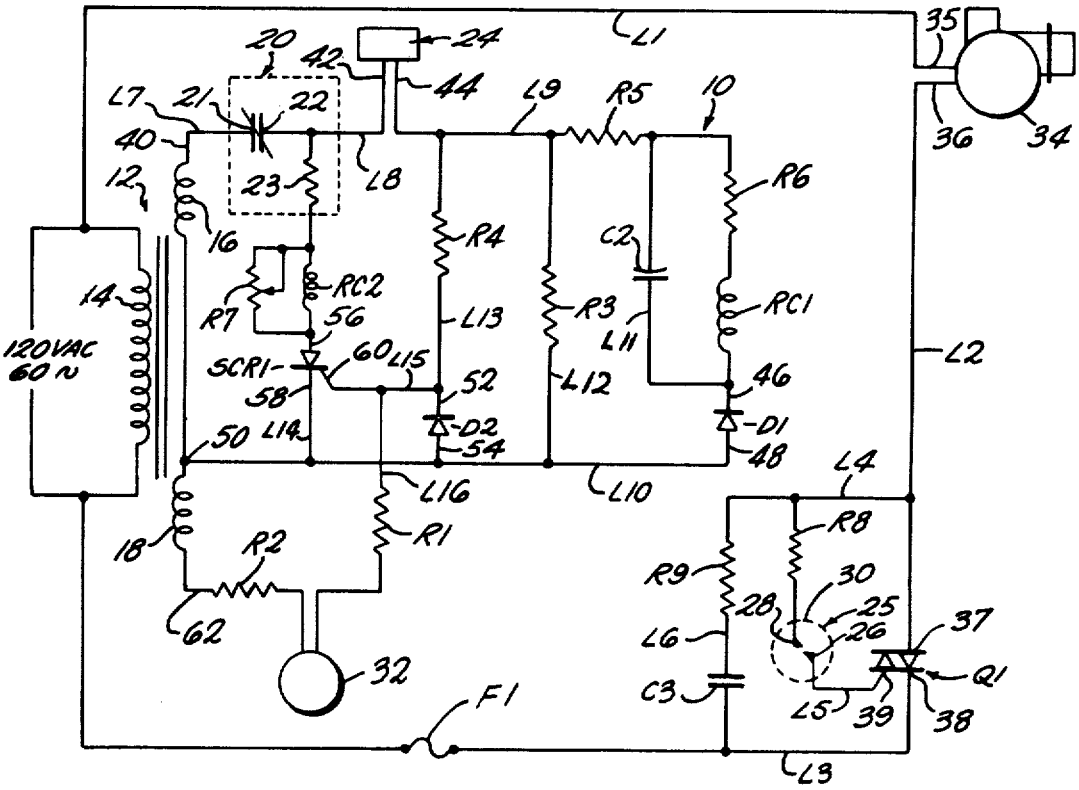
FIG. 1 is a schematic circuit diagram of a primary control embodying the present invention.
Figure 2:
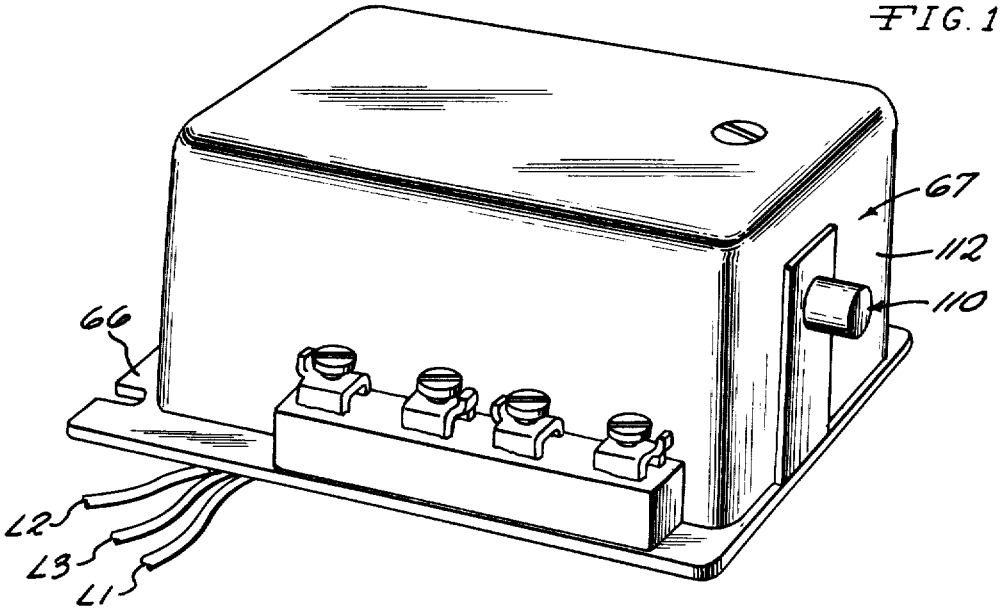
FIG. 2 is a perspective view of a primary control structure embodying the present invention.

Referring to the drawings, and more particularly to FIG. 1 thereof, the circuitry for a primary control, generally designated 10, embodying the present invention is schematically illustrated therein. As shown in FIG. 1, the primary control 10 is comprised of a step down transformer 12 having a primary winding 14 and secondary windings 16 and 18, the primary winding 14 being adapted to be connected to a conventional source of 120 volt alternating current while, in the embodiment of the invention illustrated, each of the secondary windings 16 and 18 of the isolated step-down transformer has a potential of approximately 8 volts AC. The primary control 10 also includes a bimetallic type safety switch generally designated 20, including normally closed contacts 21 and 22 and a heater coil 23; a conventional thermostat generally designated 24; a reed switch, generally designated 25, having contacts 26 and 28 and independent concentrically wound coils RC1 and RC2, the contacts 26 and 28 being enclosed within a hermetically sealed glass envelope 30 while the coils RC1 and RC2 are concentrically wound therearound; a triac Q1 and a silicon controlled rectifier SCR1. The primary control 10 also includes a cadmium sulfide flame detector 32, resistors R1, R2, R3, R4, R5, R6, R8, and R9; capacitors, C2 and C3; a potentiometer R7 and diodes D1 and D2. As shown in FIG. 1, the primary control 10 is connected to and adapted to control a conventional burner 34 of a furnace (not shown). The terminal 35 of the burner 34 is connected to the source of power by the lead L1 while the terminal 36 of the burner is connected to the terminal 37 of the triac Q1 by the lead L2, the terminal 38 of the triac Q1 being connected to the source of power by the lead L3 through a fuse F1. The contact 28 of the reed switch 25 is connected by the lead L4 to the lead L2 through the resistor R8 while the contact 26 is connected to the gate 39 of the triac Q1 by the lead L5, the resistor R9 and the capacitor C3 being connected across the leads L2 and L3 by the leads L4 and L6 to protect the triac Q1.

The terminal 40 of the secondary winding 16 is connected to the contact 21 of the safety switch 20 by the lead L7 while contact 22 of the safety switch is connected to the terminal 42 of the thermostat 24 by the lead L8, the terminal 44 of the thermostat being connected by the lead L9 through the resistors R5 and R6 and the coil RC1, to the terminal 46 of the diode D1. The terminal 48 of the diode D1 is connected to the center tap 50 of the secondary windings of the transformer 12 by the lead L10. The capacitor C2 is connected across the resistor R6 and the coil RC1 of the reed switch 25 by the lead L11 while the resistor R3 is connected between the leads L9 and L10 by the lead L12 as illustrated in FIG. 1. The terminal 44 of the thermostat 24 is also connected to the terminal 52 of the diode D2 by the lead L13 through the resistor R4, the terminal 54 of the diode D2 being connected to the center tap 50 of the transformer 12 by the lead L10. As shown in FIG. 1, the contact 22 of the safety switch 20 is connected to the terminal 56 of the silicon controlled rectifier SCR1 through the heater coil 23 and the coil RC2 of the read switch 25, the potentiometer R7 being connected across the coil RC2. The terminal 58 of the silicon controlled rectifier SCR1 is connected to the center tap 50 of the transformer 12 by the leads L14 and L10 while the gate 60 of the rectifier SCR1 is connected to the terminal 52 of the diode D2 by the lead L15 and to the terminal 62 of the secondary winding 18 of the transformer by the lead L16 through the resistor R1, the cadmium sulfide flame detector 32 and the resistor R2.

The above described components are preferably mounted on one side of the circuit board 65 as illustrated in FIG. 4 and the entire circuit structure is integrated as by soldering as illustrated in FIG. 4A. In use, the circuit board 65 is mounted on a base 66 within a housing 67.

Referring in greater detail to the components of the primary control 10, the safety switch 20 illustrated schematically in FIG. 1 and illustrated structurally in FIGS. 4, 5, 6 and 7 is comprised of a mounting base 68 adapted to be secured to the circuit board 65 of the primary control, the circuit board 65 being formed of plastic or other suitable non-conducting material having sufficient strength to withstand the forces exerted thereon in carrying the components of the primary control as illustrated in FIG. 4 and the various electrical leads as illustrated in FIG. 4A. The mounting base 68 is generally U-shaped in side view, as illustrated in FIGS. 4, 5, 6 and 7, and includes a substantially flat, horizontally extending web portion 72 having upwardly projecting flange portions 74 and 76 at the opposite ends thereof. A support bracket 78 is provided which is riveted or otherwise fixed to the upper end of the flange portion 74 as viewed in FIG. 5 and the support bracket 78 carries a bimetallic blade 80 one end of which is fixed to the free end of the bracket 78 while the opposite end of the bimetallic blade 80 carries a substantially flat bimetallic blade 82 the free end of which is provided with an integral flange 84 that projects angularly downwardly from the flat body portion of the blade 82. A pair of contact blade springs 86 and 88 are provided having struck out portions 90 and 92, respectively, which function as the normally closed contacts 21 and 22 in the safety switch 20. The blade 86 includes a generally upwardly projecting portion 94 which carries the struck out portion 90 and an integral generally horizontally extending portion 96 which is secured to the web portion 72 of the mounting base 68 by a rivet 100, the portion 96 being electrically insulated from the mounting base 68 by an electrical insulator (not shown) disposed between the portion 96 and the web portion 72 of the mounting base 68. The blade 88 includes a generally upwardly projecting portion 102 which carries the struck out contact portion 92 and an integral generally horizontally extending portion 104 which is also secured to the web portion 72 of the mounting base 68 as by a rivet 106.

As shown in FIG. 7, in the normally closed condition, the upper end portion 102 of the blade 88 is adapted to engage the free edge of the downwardly projecting portion 84 of the bimetallic blade 82 whereby the contact portion 92 is maintained in engagement with the contact portion 90 of the blade 86, an adjusting screw 108 being provided which threadably engages a projecting portion 109 on the flange 74 to permit initial adjustment of the blade 82.

The bimetallic blade 80 is adapted to bend upwardly upon an increase in temperature whereas the bimetallic blade 82 is adapted to bend downwardly upon an increase in temperature, the bimetallic blade 82 thus acting as a compensator for variations in ambient temperature. The heater element 23 surrounds the bimetallic blade element 80, the heater element 23 functioning to heat the bimetallic element 80 as will be described hereinafter in greater detail whereby the bimetallic elements 80 and 82 move upwardly so that the upper end portion of the blade spring 88 disengages from the free end of the flange portion 84 of the bimetallic blade 82 and moves to the right, as viewed in FIGS. 5, 6 and 7 so as to open the contacts 21 and 22 of FIG. 1.

Means are provided for resetting the safety switch and returning the contacts 21 and 22 to their normally closed position. Such means is comprised of an elongate plunger 110 which is preferably formed of plastic or other suitable non-conducting material and which is supported for sliding movement by the upwardly projecting flange portion 76 of the mounting base 68 and by the end wall 112 of the housing 67 of the primary control 10, the flange portion 76 and the wall 112 of the housing 67 having openings 116 and 118, respectively, which function as bearing supports for the plunger 110. The plunger 110 is of stepped construction and includes a button portion 120 and an enlarged annular flange portion 122 which is joined to the button portion 120 by a radially extending flange 124 adapted to seat in a recess 125 provided in the end wall 112 of the housing. A reduced diameter portion 126 is also provided on the plunger 110 as well as a further reduced diameter portion 128, the portion 126 being adapted to pass through the opening 116 defined by the flange 76 while the portion 128 is adapted to pass through an opening 130 defined by the blade 88 and to engage the upper end portion 94 of the blade 86. A spring 132 is provided one end portion of which engages the flange 76 of the mounting base 68 while the opposite end of the spring 132 engages the flange 124 of the plunger 110 so as to bias the plunger toward the wall 112 of the housing 67. With such a construction, when the contact portions 90 and 92 are in the open condition, as illustrated in FIG. 5, the contact portions 90 and 92 may be moved to the normally closed position by manually pushing the button portion 120 of the plunger 110 to the left as viewed in FIG. 5. The shoulder 127 intermediate the portions 126 and 128 of the plunger 110 then engages the blade element 88 while the portion 128 of the plunger 110 passes through the opening 130 in the blade 88 and engages the blade 86 so that the blades 86 and 88 move to the left and assume the position illustrated in FIG. 6, the upper end of the blade 88 engaging the outer surface of the portion 84 of the bimetallic blade 82 so as to move the bimetallic blade 82 upwardly during such operation due to the cam action of the portion 84 of the blade 82 whereby the components assume the position illustrated in FIG. 6. Closing the contact portions 90 and 92 is effected upon release of manual pressure on the end of the button portion 120 of the plunger 110, the spring 132 functioning to return the plunger 110 to the inoperative position illustrated in FIG. 7 with the flange 124 of the plunger abutting the wall 112 of the housing 67. The spring blades 86 and 88 then move back to the right as viewed in FIG. 7, and since the upper end portion 102 of the blade 88 is stopped by the free end of the downwardly inclined portion 84 of the blade element 82, the contact portions 90 and 92 close and remain closed until the switch is again opened by upward movement of the blade 82.

The rectifier SCR1 is a conventional silicon controlled rectifier and may, for example, carry a rating of approximately four amperes. The thermostat 24 may be of any desired or conventional construction while the reed switch 25 is preferably of the type disclosed in the applicant's co-pending application entitled "Switch Construction." As previously mentioned, such a switch is comprised of a pair of contacts 26 and 28 carried by reeds hermetically sealed within a glass envelope 30. Such a reed switch also includes the electrically insulated, independently wound concentric coils RC1 and RC2, the magnetic fluxes of such coils being additive when in phase. The reed switch 25 preferably has a very large differential between pull-in and drop-out ampere turns or coil power. By way of example, the reeds preferably will pull in at about 60 ampere turns, but will not drop out until below 20 ampere turns, a ratio of at least 3 to 1. In the embodiment of the invention illustrated in FIG. 1 the maximum power to the coil RC1 is well below that required to pull-in the reed switch and close the contacts 26 and 28. The power is, however, enough to hold the reed switch contacts 26 and 28 closed once pull-in has been established, due to the very large differential. The reed switch coil RC2, on the other hand, has sufficient power when combined with RC1 to pull in the reed switch. Since reed switches are very fast they are capable of following an alternating current voltage to open or close 60 or 120 times per second. To avoid this opening and closing and the associated wear, the diode D1 and capacitor C2 are provided. The diode D1 is preferably a 200 milliampere diode which supplies half wave rectified current to the capacitor C2 to establish a DC supply for the reed switch coil RC1. The capacitor C2 is preferably a 47 microfarad 15 volt DC capacitor. The diode D1 and capacitor C2 function to form a DC supply for the holding coil RC1 so that flux is always present on the coil RC1 when the thermostat call for heat. This flux is very small however. With such a construction and since relatively small current passes through the contacts 26 and 28, such contacts are very reliable over a relatively long life.

The triac Q1 is a bidirectional thyrister which may be gate triggered from a blocking to a conducting state for either polarity of applied voltage, and is preferably mounted in a recess 135 defined by an integral flange 136 projecting outwardly from one side of the base 66 and functioning to isolate the other components of the control 10 from the heat generated by the triac Q1. The resistors R1 and R2 are preferably carbon resistors having ratings of 150 ohms and 560 ohms, respectively, ½ watt, the purpose of the resistor R1 being to prevent the accidental destruction of the diode D1, transformer 12 or silicon controlled rectifier SCR1 by a serviceman in the field. In this connection the resistors R1, R2, R5 and R9, the diode D2 and the capacitor C3 are all provided in the primary control 10 solely for the purpose of protecting other components and to protect against erroneous wiring in the field. The resistors R1, R2, R5 and R9, the diode D2 and the capacitor C3 are thus not essential to the basic circuit performance.

Typical values for the components in the control system described above are as follows:

| | |
|---|---|
| SCR1 | 4 AMP Silicon controlled rectifier |
| D1 | 200 Ma diode |
| D2 | 200 Ma diode |
| R1 | Carbon resistor 150 ohms, ± 20%, ½ watt |
| R2 | Carbon resistor 560 ohms, ± 20%, ½ watt |
| R3 | Wirewound resistor 20 ohms, ± 20%, 5 watt |
| R4 | Carbon resistor 3300 ohms, ± 20%, ½ watt |
| R5 | Carbon resistor 47 ohms, ± 20%, ½ watt |
| R6 | Wirewound resistor 680 ohms, ± 20%, 1 watt |
| R7 | Wirewound potentiometer 1 ohm, ± 20%, 2 watt |
| R8 | Carbon resistor 82 ohms, ± 20%, ½ watt |
| R9 | Carbon resistor 82 ohms, ± 20%, ½ watt |
| C2 | Capacitor 47 mfd 15 VDC |
| C3 | Capacitor 22 mfd 200 V Mylar foil |

It will be understood, however, that these values may be varied depending upon the particular application of the principles of the present invention.

Assuming a basic knowledge of the triac Q1, the silicon controlled rectifier SCR1, and the cadmium sulfide flame detector 32, a typical thermostat cycle operates in the following manner. It should be noted initially that whenever the reed contacts 26 and 28 are closed, current will flow from the source of electric power through the lead L1, the burner 34, the lead L2, the resistor R8 and the contacts 26 and 28, to the gate of the triac Q1 and the lead L3. When the gate of the triac Q1 is energized the full motor current will then pass through the triac Q1. This starts the burner and has the same effect as closing a set of relay contacts between the lead L2 and the lead L3.

Whenever the thermostat contacts close, a continuous holding flux is established in the coil RC1 by the DC supply network comprised of the diode D1 and the capacitor C2. Current also flows through the resistor R4 to the gate 60 of the silicon controlled rectifier SCR1. If the cadmium sulfide flame detector 32 registers darkness, no current can be shunted away from the gate 60 of the silicon controlled rectifier SCR1 and SCR1 will conduct. When SCR1 conducts, current also passes through the pull-in coil RC2 of the reed switch 25 and the heater 23 of the safety switch 20. With a flux established in the coil RC2 and the coil RC1, the reed switch contacts 26 and 28 will pull in and the triac Q1 will start the burner. If the cadmium sulfide flame detector 32 does not register flame, the silicon controlled rectifier SCR1 will continue to conduct and the safety switch 20 will open the contacts 21 and 22 due to the heating action of the heater 23 raising the bimetallic blade 82 through the raising of the bimetallic blade 80. It is preferred that the contacts 21 and 22 open and lock out after approximately 15 seconds. If the cadmium sulfide flame detector registers flame, then the flame detector 32 decreases in resistance and shunts current away from the gate 60 of the rectifier SCR1. SCR1 will no longer conduct, the heating coil 23 of the safety switch will be deenergized but the coil RC1 will continue to hold in the reed relay contacts 26 and 28.

If the cadmium cell 32 registers flame and for some reason the flame should go out during the thermostat cycle, the rectifier SCR1 will again conduct and the heating coil 23 will be energized so as to open the contacts 21 and 22 into a lock-out condition. When the thermostatic conditions are satisfied and the contacts thereof open, the coil RC1 is deenergized thereby opening the contacts 26 and 28 and also deenergizing the triac Q1. No current is then available through the resistor R4 to energize SCR1 even though the cadmium cell 32 registers no flame. It should also be understood that the same cycle would occur if the thermostat were connected to line voltage and placed in one leg of the transformer primary control.

An important aspect of the present invention resides in the fact that if there is a failure in the primary control 10, the primary control 10 will fail in a safe condition. For example, if the silicon controlled rectifier SCR1 is shorted from anode to cathode it will conduct electric current supplied by the secondary winding 16 of the transformer. The cadmium sulfide flame detector 32 will have no effect on the control circuit. Since current through the rectifier SCR1 must also pass through the safety switch heater 23, the safety switch contacts 21 and 22 will open after approximately 8 seconds into a lock-out condition. The only way to start the burner again is by depressing the manual reset plunger 110. An open circuit in the rectifier SCR1 will render the control circuit inoperative since no starting current is provided in the coil RC2. The burner will thus never start. A short circuit from the gate to the cathode of the rectifier SCR1 has the same effect as an open circuit between the anode and cathode of SCR1. An open circuit from gate to cathode of the rectifier SCR1 also has this effect.

Failure of the diode D1 in the short circuit causes AC voltage to appear across the capacitor C2 and since AC voltage is destructive to the capacitor C2 it will generally cause it to fail short circuited. Hence, there is no coil power to the reed switch coil RC1 and the reed switch is incapable of holding. The burner would then become inoperative. If the diode D1 fails open circuited, there is likewise no power to the coil RC1 and the burner becomes inoperative.

A short circuit failure of the diode D2 reacts the same as a gate to cathode short of the rectifier SCR1 as previously described. An open circuit failure of the diode D2 will generally be destructive to the rectifier SCR1 and any failure of the SCR1 will render the control circuit inoperative as previously described.

An open or short circuit failure of the capacitor C2 will prevent the reed switch 25 from pulling in and the burner from operating. The burner will also be prevented from operating if either of the coils RC1 or RC2 of the reed switch 25 become open or short circuited since such failure will prevent the reed switch from pulling in and closing the contacts 26 and 28.

The resistor R1 prevents the accidental destruction of the diode D2 by a serviceman in the field. This could happen if a serviceman accidentally shorted one of the thermostat terminals with the proper terminal of the cadmium sulfide flame detector 32. Open circuit failure would react in the same manner as an open circuit in the flame detector 32. Short circuit of either of the resistors R1 or R2 would simply eliminate the protection measure from the equipment.

The resistor R3 is a wirewound type so that short circuit failure can be beglected. Open circuit failure of the resistor R3 would result in elimination of thermostat bias current used for conventional thermostat "pre-heaters." The resistor R3 plays no other role in the circuit other than for this home comfort feature.

Continuing the description of the fail-safe operation of the primary control 10, the resistor R4 is utilized for the purpose of calibrating the cadmium sulfide flame detector 32. If the resistor R4 is open circuited then SCR1 never receives current from gate to cathode and will never turn on. Since the rectifier SCR1 must conduct to pull in the reed switch through the coil RC2, the burner will never turn on. If the burner is in the middle of a cycle when the resistor R4 fails open, then the burner will fail to start on the next cycle. If the resistor R4 fails in a short circuit condition, then neither of the coils RC1 or RC2 will be energized and the reed switch contacts will not close so that the burner will be inoperative.

The resistor R5 protects the diode D1 from current surges to the capacitor C2 during normal operation. If the resistor R5 were to short circuit then the diode D1 may fail shorted and the burner would become permanently inoperative in the manner previously described in connection with the failure of the D1. If the resistor R5 fails open circuited, then no power will be furnished to the coil RC1 and the reed switch contacts will not close. The burner would then be inoperative.

The resistor R6 functions to limit the power to the coil RC1. The resistor R6 is calibrated and calibrates the coil RC1 to within a specified drop-out range for the reed switch. As is well known, wire wound resistors do not fail short. If open circuit failure results, then no power is supplied to the coil RC1 and the reed switch will not pull in. The burner will thus be inoperative if the resistor R6 fails open circuited.

The wire wound potentiometer R7 is used to calibrate the pull-in voltage of the reed switch. This is accomplished by shunting current away from the reed switch coil RC2. An open circuit in the potentiometer R7 allows the reed switch to pull in at lower line voltage than the set-point voltage, as for example 90 volts. Short circuit of the potentiometer R7 prevents power from flowing to the reed switch coil RC2 and the reed switch will not close the contacts 26 and 28. The burner will then be inoperative.

The heating coil of the safety switch 20 cannot fail shorted. An open circuit failure functions in the same manner as an open circuit failure of the anode to cathode on the rectifier SCR1 previously described. With respect to the cadmium sulfide flame detector 32, this flame detector maintains approximately 1,500 ohms at 1 foot candle illumination. Short circuit results in the failure to start the burner when the thermostat closes. An open circuit causes the safety switch 20 to lock out.

While a preferred embodiment of the invention has been illustrated and described, it will be understood that various changes and modifications may be made without departing from the spirit of the invention.

What is claimed is:

1. In an electrical primary control system for furnaces, the combination including burner control means adapted to be connected to a main line source of AC current, a low voltage control circuit including burner ignition detection means, means providing a substantially lower voltage than line voltage in said control circuit, means in said low voltage control circuit including solid state means effective to actuate said burner control means in response to a signal from said ignition detection means, energy conversion means effective to interrupt the flow of current through said solid state means, said energy conversion means including a mounting base, first and second bimetallic blades, one end portion of said first blade being fixed to said base, the other end portion of said first blade being fixed directly to one end portion of said second blade, said first and second blades bending in opposite directions upon an increase in temperature, stop means carried by the other end portion of said second blade, a pair of contact members fixed to said base, said contact members being in electrical contact with each other when one of said members is in engagement with said stop means, electrical heating means encompassing said first blade and effective to heat said first blade to cause said stop means to be disengaged from said one contact member responsive to bending of said first blade, the directions of bending of said first and second blades responsive to change in temperature being such that an increase in temperature of said second blade will tend to counteract deflection of said stop means responsive to an equivalent increase in temperature of said first blade, manually operable means supported by said base and effective to move said contact member into engagement with said stop means, and means interfacing between said low voltage control circuit and said burner control means.

2. In an electrical primary control system for furnaces, the combination including burner control means adapted to be connected to a furnace burner connected to a main line source of AC current, a low voltage control circuit including burner ignition detection means, means providing a substantially lower voltage than line voltage in said control circuit, means in said low voltage control circuit including solid state means effective to actuate said burner control means in response to a signal from said ignition detection means, electrical switch means effective to interrupt the flow of current through said solid state means, said electrical switch means including a hoursing having an end wall, a U-shaped mounting base having a web portion and a pair of spaced flange portions disposed in said housing, first and second bimetallic blades, one end portion of said first blade fixed to one of said flange portions, the other end portion of said first blade being fixed directly to one end portion of said second blade, said first and second blades bending in opposite directions upon an increase in temperature, stop means carried by the other end portion of said second blade, a pair of resilient contact members fixed to said web portion of said base, said contact members being in electrical contact with each other when one of said members is in engagement with said stop means, electrical heating means encompassing said first blade and being effective to heat said first blade to cause said stop means to be disengaged from said one contact member responsive to bending of said first blade, the directions of bending of said first and second blades responsive to a change in temperature being such that an increase in temperature of said second blade will tend to counteract deflection of said stop means responsive to an equivalent increase in temperature of said first blade, a manually operable plunger, said plunger being supported for axial movement by the other of said flange portions and said end wall of said housing, said plunger sequentially engaging said contact members upon the application of manual force thereto and maintaining separation of said members until said one contact member engages said stop means, resilient means biasing said plunger away from said one contact member and toward said end wall, and means interfacing between said low voltage control circuit and said burner control means.

3. In an electrical primary control system for furnaces, the combination including a burner control triac adapted to be connected to a main line source of AC current, a low voltage control circuit including burner ignition detection means, means providing a substantially lower voltage than line voltage in said control circuit, means in said low voltage control circuit including solid state means effective to actuate said burner control triac in response to a signal from said ignition detection means, energy conversion means including a switch means effective to interrupt the flow of current through said solid state means, and means interfacing between said low voltage control circuit and said burner control triac.

4. The combination as set forth in claim 3 wherein said switch means includes time delay means.

5. The combination as set forth in claim 3 wherein said ignition detection means controls the flow of current through said solid state means.

6. The combination as set forth in claim 3 wherein said interfacing means controls the conduction of said burner control triac.

7. In an electrical primary control system for furnaces, the combination including a burner control triac, said triac including one main terminal adapted to be connected to a furnace burner, said triac including another main terminal adapted to be connected to a main line source of AC current, said triac also including a gate for rendering said triac conductive across said main terminals when said gate is energized, a low voltage control circuit including burner ignition detection means and energy conversion means, means providing a substantially lower voltage than line voltage in said control circuit, means in said low voltage control circuit including solid state means effective to energize said gate of said burner control triac in response to a signal from said ignition detection means, electrical switch means controlled by said energy conversion means and effective to interrupt the flow of current through said solid state means, and means interfacing between said low voltage control circuit and said gate of said burner control triac.

* * * * *